US009981672B2

(12) United States Patent
McCulloch

(10) Patent No.: US 9,981,672 B2
(45) Date of Patent: May 29, 2018

(54) RAILWAY VEHICLE

(71) Applicant: W & D MCCULLOCH LTD., Girvan (GB)

(72) Inventor: William Francis McCulloch, Girvan (GB)

(73) Assignee: W & D MCCULLOCH LTD., Girvan (GB)

( * ) Notice: Subject to any disclaimer, the term of this patent is extended or adjusted under 35 U.S.C. 154(b) by 244 days.

(21) Appl. No.: 14/891,911

(22) PCT Filed: Jun. 10, 2014

(86) PCT No.: PCT/GB2014/051787
§ 371 (c)(1),
(2) Date: Nov. 17, 2015

(87) PCT Pub. No.: WO2014/199146
PCT Pub. Date: Dec. 18, 2014

(65) Prior Publication Data

US 2016/0107660 A1 Apr. 21, 2016

(30) Foreign Application Priority Data

Jun. 14, 2013 (GB) ..... 1310596.0

(51) Int. Cl.
*B61K 5/02* (2006.01)

(52) U.S. Cl.
CPC ..... *B61K 5/02* (2013.01)

(58) Field of Classification Search
CPC .. B61K 5/00; B61K 5/02; E01B 29/00; E01B 29/02; E01B 29/05; E01B 31/00; E01B 33/00
See application file for complete search history.

(56) References Cited

U.S. PATENT DOCUMENTS 4,606,273 A * 8/1986 Theurer ..... B61K 5/02 104/261

FOREIGN PATENT DOCUMENTS

GB 2218398 A 11/1989
JP H06219276 A 8/1994
(Continued)

OTHER PUBLICATIONS

Blakeney, Anne; "Persons Working on or Near to AC Electrified Lines"; Railway Group Standard, GE/RT8024, Issue One; Oct. 2000; 10 pages.
(Continued)

*Primary Examiner* — Robert J McCarry, Jr.
(74) *Attorney, Agent, or Firm* — Winstead PC

(57) ABSTRACT

The invention relates to a self-propelled vehicle (10) provided only with rail-engaging rolling means (18) comprising: a chassis (14); a working surface (16) connected thereto for supporting equipment, materials (20) and personnel; and positioning means (22, 24) connected to the chassis for lifting the vehicle and moving it laterally with respect to a direction of rail travel between a trackside location and an on-track location (12). A lifting apparatus (28) is mountable on the chassis and moveable along the length of the working surface (16). By providing only rail-engaging rolling means (18), the height of the vehicle's overlying working surface (16) above the track (12) and surrounding ground is significantly reduced as compared to existing dual purpose road-rail vehicles. The vehicle is capable of working safely below live overhead lines and alongside tracks open to traffic thus avoiding the need to for full closure of tracks during maintenance and inspection works.

17 Claims, 3 Drawing Sheets

(56) References Cited

FOREIGN PATENT DOCUMENTS

| | | | |
|---|---|---|---|
| JP | 2007320491 | A | 12/2007 |
| KR | 100809040 | B1 | 3/2008 |
| KR | 20100044546 | A | 4/2010 |
| WO | WO-9513930 | A1 | 5/1995 |
| WO | WO-2006021878 | A1 | 3/2006 |

OTHER PUBLICATIONS

Network Rail; "Guidance for Managing Plant Working next to Lines Open to Traffic"; RRV Safety Improvement Programme, Issue 2; Dec. 2012; 32 pages.

Schultze, Yves, "International Search Report," prepared for PCT/GB2014/051787, dated Sep. 15, 2014, four pages.

* cited by examiner

RAILWAY VEHICLE

The present invention relates to a railway vehicle and particularly, though not exclusively, to a self-propelled and self-mountable/dismountable railway vehicle having only rail-engaging rolling means. The railway vehicle may be configurable for transporting a multiplicity of materials, personnel, and inspection and maintenance equipment.

Rail network infrastructure requires ongoing track and trackside inspection, maintenance and enhancement works. However, in order to eliminate or minimise disruption to commercial rail services, access windows for engineering possessions are necessarily very limited and subject to heavy regulation in order to meet increasingly stringent safety criteria. Consequently, a wide variety of railway vehicles have been developed with the aim of minimising time wasted in delivering railway vehicles to the site of engineering works and hence maximising useful working time within the possession window available.

For example, attempts have been made to address this problem by utilising road-rail vehicles which employ both conventional road wheels for travelling on roads, and retractable rail bogies for travelling on rails. However, whilst such road-rail vehicles may overcome some problems associated with transporting engineering vehicles from a depot—e.g. by facilitating access to the railway at a location significantly nearer to a site of engineering works—several disadvantages nevertheless remain.

First and foremost, dual purpose road-rail vehicles are extremely expensive. Usually such vehicles are commercial trucks which have been specially adapted for travelling on rail and so are over-engineered for each of their purposes in isolation. Also, the process of mounting a road-rail vehicle onto the railway can often be problematic. Often, the most appropriate site for mounting the vehicle onto a railway track will be at a level crossing. However, the nearest suitably sized level crossing may be some way distant from the site of proposed engineering works.

Access to the railway track at a greater number of track locations has been enabled by providing pivotable rear rail bogies or turntable systems in combination with temporary ramps. This type of apparatus thus allows a vehicle to be transferred in stages from its road configuration to its rail configuration where a level crossing is not available. An example of such a road-rail vehicle which uses a combination of fixed and rotatable bogies is disclosed in international patent publication No. WO95/13930 (Swedish Rail System AB SRS). However, the provision of pivotable rear rail bogies or turntable systems still relies on complex and expensive vehicles—predominantly intended for road travel—and sufficient trackside space to enable them to be manoeuvred in stages onto the track.

The present applicant has identified a need for an alternative railway vehicle which provides a simpler, more flexible and relatively inexpensive solution to the problem of improving useful working time within available possession windows for track and trackside inspection, maintenance and enhancement works.

According to a first aspect of the present invention there is provided a self-propelled vehicle, the vehicle provided only with rail-engaging rolling means and comprising:

(i) a chassis;

(ii) a working surface connected to the chassis for supporting equipment and/or materials and/or personnel;

(iii) the rail-engaging rolling means connected to the chassis for travel on a railway track; and (iv) positioning means connected to the chassis for lifting the vehicle and moving it laterally with respect to a direction of rail travel between a trackside location and an on-track location;

wherein the working surface extends over the chassis and above the rail-engaging rolling means; and wherein a lifting apparatus is mountable on the chassis and moveable along the length of the working surface.

Advantageously, by providing only rail-engaging rolling means, the height of the vehicle's overlying working surface above the track and surrounding ground is significantly reduced as compared to dual purpose road-rail vehicles. This is because road-rail vehicles have larger diameter road wheels which necessarily support their working surfaces for supporting engineering equipment and/or materials and/or personnel at a relatively higher location above the rail track and surrounding ground. The deployment of retractable rail wheels onto the track causes the working surface to be raised even further as the road wheels are raised above the height of the track. The applicant of the present invention estimates that, relative to typical road-rail vehicles, a lowering of the working surface height in the range of at least 450 mm to 650 mm can be achieved. Advantageously, a lifting capacity of at least 4 tonnes—and potentially up to 60 tonnes—is envisaged so as to facilitate the full range of lifting tasks commonly encountered during engineering works.

Optionally, the positioning means comprises a primary lifting means for engagement with the ground to lift the vehicle in a substantially vertical direction; and shifting means connected thereto for moving the vehicle in a substantially horizontal direction over the ground.

Optionally, a secondary supporting means is connected to the chassis for engagement with the ground to lift the vehicle in a substantially vertical direction, and/or for supporting the vehicle in a substantially stationary manner relative to the ground during operation of the positioning means.

Advantageously, the primary and secondary supporting means are capable of supporting the weight of both the railway vehicle and its load. For example, a load capacity of approximately 30 tonnes is envisaged. Accordingly, a fully loaded railway vehicle can be delivered and positioned adjacent a railway track well in advance of planned engineering works hence.

Optionally, all lifting means are independently telescopically extendable.

Optionally, all shifting means are independently telescopically extendable.

Advantageously, by allowing the primary and secondary supporting means to be operable independently of each other stability of the vehicle is maintained even whilst some parts of the primary and/or secondary supporting means are not engaged with the ground. Furthermore, this arrangement accommodates undulations on the ground by facilitating appropriate height adjustment of each individual lifting means. Similarly, each shifting means may be independently telescopically extendable to allow a degree of directional control of the rail vehicle as it is moved in a horizontal direction over the ground.

Optionally, the shifting means extend substantially horizontally across the lateral width of the chassis and the primary lifting means depend substantially vertically from the shifting means at opposite ends thereof.

It will be appreciated that the width is measured between the longitudinal sides of the rail vehicle which extend parallel to the direction of rail travel when the rail vehicle is on the track.

Optionally, the primary lifting means depend from the shifting means at positions laterally beyond both the chassis and the rail-engaging rolling means at opposite longitudinal sides of the chassis.

Optionally, the positioning means comprises at least two sets of telescopically extendable shifting means proximate front and rear ends of the chassis respectively, each being provided with two telescopically extendable primary lifting means depending from opposite ends thereof.

Optionally, the secondary supporting means depends from the chassis at a position laterally between each pair of primary lifting means.

Optionally, the lifting apparatus is mountable for rotational movement relative to the chassis about a vertical axis.

Optionally, the angle of rotation of the lifting apparatus about the vertical axis relative to the working surface can be physically and permanently limited to an angular range which is less than 360 degrees.

Optionally, the rotational movement of the lifting apparatus about the vertical axis is configurable so as to be limited to a maximum angle lying within the range of 180 degrees to 200 degrees.

Advantageously, by preventing rotational movement over 180 degrees relative to the direction of the railway track it becomes possible to ensure that no part of the lifting means extends beyond one longitudinally extending side of the footprint of the rail vehicle, i.e. beyond one side of its outermost vertical projection on the ground. Consequently, the lifting means can be safely operated without the need to close an adjacent railway track during engineering works. Dependent upon the actual width dimensions of the railway vehicle, the lifting apparatus used, its mounting position on the chassis, the maximum dimensions and orientations of the loads to be lifted, and the overall reach of its lifting arm etc, rotational movement may be permitted beyond 180 degrees—e.g. over an additional 20 degrees—without the need to close an adjacent railway track. In some circumstances—e.g. where there is no adjacent line, or where all adjacent lines are closed—there will be no need to provide any kind of physical and permanent means of limiting the angular travel of the lifting apparatus. Therefore, different railway vehicles can be provided for different operational requirements. For reasons of safety, a removable locking means, e.g. a locking pin, is undesirable due to the risks associated with possible structural failure or human error Optionally, vertical movement of any part of the lifting apparatus relative to a stowed position above the working surface is configurable so as to maintain a minimum distance of 2.75 meters from any overhead line equipment.

Advantageously, this allows the lifting means to be safely operated beneath live overhead line equipment whilst complying with applicable safety legislation in the United Kingdom, namely Railtrack PLC's Railway Group Standard GE/RT8024 dated October 2000 titled "Persons Working On or Near to AC Electrified Lines".

According to a second aspect of the present invention there is provided a method of mounting a vehicle according to the first aspect onto a railway track comprising the steps of:

(i) delivering the vehicle to a trackside location;

(ii) deploying the positioning means to lift the vehicle above the height of the railway track;

(iii) operating the positioning means to move the vehicle laterally with respect to a direction of rail travel from its trackside location to an over-the-track location;

(iv) operating the positioning means to lower the vehicle such that its rail-engaging rolling means engage with the railway track; and (v) stowing the positioning means to allow the vehicle to travel on the railway track.

Optionally, the step of deploying the positioning means to lift the vehicle comprises telescopically extending at least four primary lifting jacks spaced around the vehicle until they engage the ground and lift the vehicle above the height of the railway track.

Optionally, the step of deploying the positioning means to lift the vehicle is preceded by telescopically extending a shifting member away from a side of the vehicle in the direction of desired movement.

Optionally, the step of telescopically extending a shifting member away from a side of the vehicle is preceded by telescopically extending at least one secondary support member connected to the chassis at a location intermediate the primary lifting jacks until it engages the ground to lift and/or support the vehicle during extension of the shifting member.

Optionally, the step of operating the positioning means to move the vehicle laterally with respect to a direction of rail travel involves retracting any previously deployed secondary supporting members away from the ground; and retracting extended shifting members on one side of the vehicle whilst simultaneously extending retracted shifting members on the opposite side of the vehicle.

Optionally, the step of stowing the positioning means to allow the vehicle to travel on the railway track involves retracting the primary lifting jacks away from the ground and retracting all extended shifting members on each side of the vehicle.

Embodiments of the present invention will now be described, by way of example only, with respect to the accompanying drawings in which.

Figure 1:
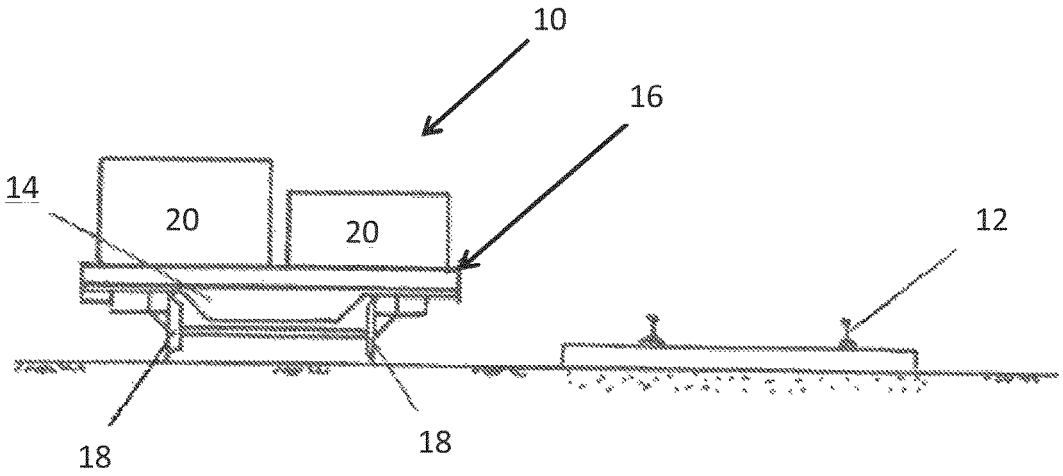
FIG. 1 shows a schematic end view representation of a railway vehicle according to the present invention positioned on the ground at a trackside location.

FIG. 1 shows a railway vehicle (10) which has been delivered to a trackside location whereby it rests on the ground parallel to the railway track (12). The vehicle (10) comprises a supporting chassis (14) which supports a planar working surface (16). Rail-engaging rolling means (18) which may be in the form of rail bogies, are connected to the chassis (14). The vehicle (10) is provided with a diesel engine of suitable capacity which can also be used to operate any on-board hydraulic equipment and fail-safe hydrostatic wheels at speeds of up to approximately 32 kph (20 mph). An additional slave engine may be mounted on the chassis as a back-up power supply.

In order to maximise the useful working time within the available possession window provided the working surface (16) of the vehicle (10) has been pre-loaded with all appropriate equipment and materials (20) in readiness for the particular engineering tasks to be carried out. It will therefore be appreciated that the vehicle can be delivered to a convenient trackside location by road well in advance of planned engineering works. Consequently, by providing numerous—relatively low cost rail-only vehicles—the logistics associated with moving equipment and materials to the site of engineering works are made more flexible and are greatly simplified as compared to using road-rail vehicles.

Figure 2:
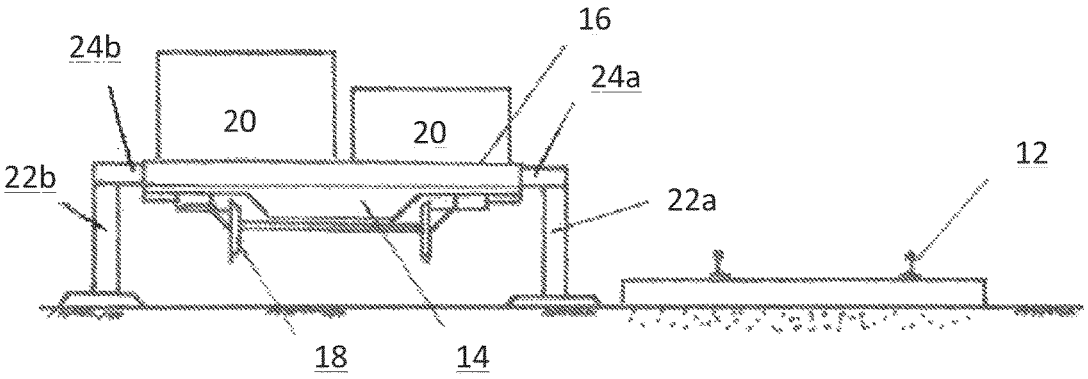
FIG. 2 shows a schematic end view representation of the railway vehicle of FIG. 1 lifted off the ground by primary lifting jacks.
Figure 3:
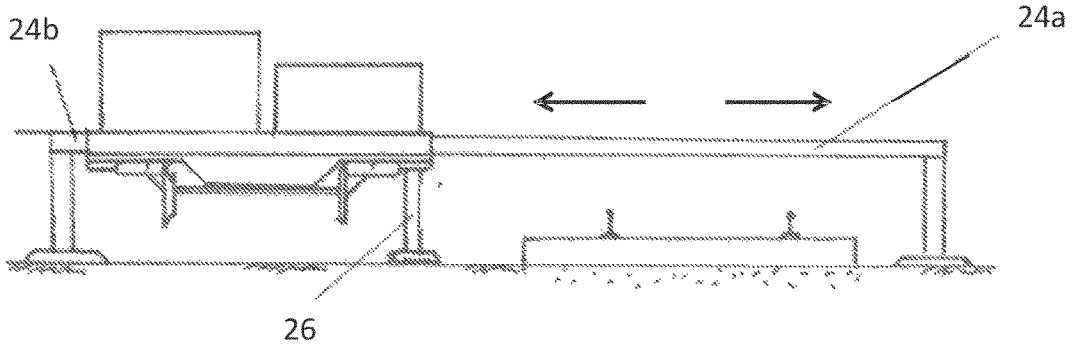
FIG. 3 shows a schematic end view representation of the railway vehicle of FIG. 2 whereby a shifting member on one side thereof has been extended away from the vehicle whilst it is supported by a secondary support member.
Figure 4:
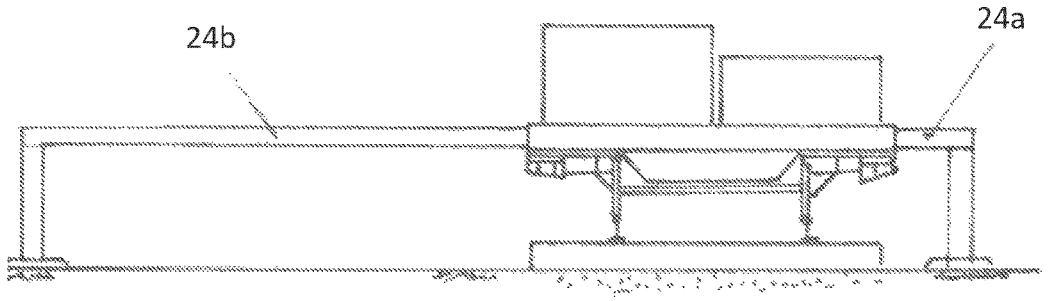
FIG. 4 shows a schematic end view representation of the railway vehicle of FIG. 3 after it has been moved from its trackside location to an over-the-track location by simultaneous extension and retraction of its shifting members on either side of the vehicle.

Once a possession window opens, a pre-loaded railway vehicle (10) can be immediately moved from its trackside location—which is preferably at, or as close as possible to, the site of the planned engineering works—onto the railway track (12). This is achieved by means of a sideways "crab" movement (described further below) made possible by cooperating telescopically extendable (vertical) lifting jacks (22*a*, 22*b*) and telescopically extendable (horizontal) shifting members (24). As shown in FIGS. 2 to 4, two lifting jacks (22*a*, 22*b*) depend from opposite ends of each shifting member (24) such that each lifting jack (22*a*, 22*b*) is extendable towards the ground laterally beyond each of the chassis (14), the working surface (16), and the rail-engaging rolling means (18). Each shifting member (24) extends laterally across the width of the vehicle (10) and is connected to the chassis (14). Although only one shifting member (24) with two associated lifting jacks (22*a*, 22*b*) is shown in the figures, it will be appreciated that the vehicle (10) will comprise multiple such positioning means dependent upon its overall length and the loads to be supported.

The first step in the process of moving the vehicle (10) from its trackside location onto the track (12) is shown in FIG. 2. At least four telescopic lifting jacks (22*a*, 22*b*) are deployed from a stowed position (not shown) and are extended away perpendicularly from the outer ends of each shifting arm (24*a*, 24*b*) of the shifting members (24) until they engage the ground. Continued extension of the lifting jacks (22*a*, 22*b*) causes the vehicle (10) to be lifted off the ground such that its rail-engaging rolling means (18) are supported at a height above that of the adjacent railway track (12).

The second step in the process of moving the vehicle (10) from its trackside location onto the track (12) is shown in FIG. 3. A secondary support member (26) which is connected to the chassis (14) has been deployed from a stowed position (not shown) adjacent one of the lifting jacks (22*a*). Once in position, the adjacent lifting jack (22*a*) may be retracted away from the ground without compromising the stability of the vehicle (10) in its raised trackside position. Once the lifting jack (22*a*) is retracted to the extent that its lower ends lie above the railway track (12) the corresponding shifting arm (24*a*) may be extended laterally away from vehicle (10). Once the shifting arm (24*a*) is extended to the appropriate length, the corresponding lifting jack (22*a*) is then re-engaged with the ground in the same manner as described above. The above process may occur simultaneously with multiple sets of shifting arms (24*a*) and lifting jacks (22*a*).

Depending upon the presence or absence of any ground incline, during re-engagement the lifting jacks (22*a*) may need to be extended less than or more than the opposing lifting jacks (22*b*) in order to maintain the vehicle in a horizontal orientation whilst maintaining its rail-engaging rolling means (18) at a height above that of the adjacent railway track (12). Once the lifting jacks (22*a*, 22*b*) are properly adjusted the support member (26) can be retracted or pivoted away from the ground into its stowed position.

The third step in the process of moving the vehicle (10) from its trackside location onto the track (12) is shown in FIG. 4. Shifting arm (24*b*) is gradually extended whilst simultaneously retracting shifting arm (24*a*) so as to move the vehicle (10) to an over-the-track position. Depending upon the length of the shifting arms (24*a*, 24*b*) and the proximity of the vehicle (10) to the railway track (12), multiple "crab" movements may be required to achieve an over-the-track position. Once the rail-engaging rolling means (18) are aligned with the railway track (12) the lifting jacks (22*a*, 22*b*) can be retracted together to lower the vehicle (10) onto the railway track (12). Continued retraction of the lifting jacks (22*a*, 22*b*) will cause them to disengage from the ground. Once the lifting jacks (22*a*, 22*b*) are fully retracted, the extended shifting arm (24*b*) can also be retracted within the chassis (14). The lifting jacks (22*a*, 22*b*) can then be stowed to allow the vehicle (10) to travel on the railway track (12).

One advantage of providing a vehicle (10) having only rail-engaging rolling means (18) is that the height of the vehicle's overlying working surface (16) above the track (12) and surrounding ground is significantly reduced as compared to dual purpose road-rail vehicles. This is because road-rail vehicles typically have significantly larger wheel diameters which therefore support their working surfaces at a relatively higher location above the rail track and surrounding ground. The deployment of retractable rail wheels onto the track causes the working surface to be raised even further as the road wheels are raised above the height of the track. The applicant of the present invention estimates that, relative to typical road-rail vehicles, a lowering of the working surface height in the range of at least 450 mm to 650 mm can be achieved. This reduction in height is of paramount importance in facilitating the ability of the vehicle (10) to employ lifting apparatus under live overhead lines.

Two alternative means of delivering the rail vehicle (10) are envisioned. One possibility is that the rail vehicle could be brought to a desired trackside location by, for example, a trailer of a suitable road vehicle. By loading the rail vehicle (10) on the trailer such that its longitudinal sides overhang the trailer's supporting surface the aforementioned lifting jacks (22*a*, 22*b*) could be deployed and extended to raise the rail vehicle (10) away from, and support it above, the trailer. The trailer may then be driven away from beneath the rail vehicle (10). Alternatively, the rail vehicle (10) could be rolled off the rear of a trailer via ramps and/or via integrated tracks on the trailer. This could be assisted by means of a winching mechanism.

Various power outlets (not shown) may be provided on the vehicle (10) to drive a variety of pneumatic, hydraulic and electrical tools, and any lighting equipment which may be required. Accordingly, it will be appreciated that as well as being self-mountable/dismountable (to/from both a delivery vehicle and a railway track) and self-propelling, the vehicle (10) is also self-contained insofar as it may be provided with all equipment and power sources required during engineering, maintenance or inspection works. Moreover, the vehicle (10) in accordance with the present invention may be provided in different lengths, e.g. 6 m to 12.5 m, and/or multiple vehicles may be linked together to accommodate the scale of a particular engineering or maintenance task.

The vehicle (10) has been designed to address many of the major safety issues that place severe restrictions on the modus operandi of currently available vehicles. In particular, the vehicle (10) of the present invention can be operated in compliance with current stringent safety legislation, including:

(i) Railtrack PLC's Railway Group Standard GE/RT8024 dated October 2000 titled "Persons Working On or Near to AC Electrified Lines"—at present, lifting devices and excavators are not permitted to operate under live wires due to the possibility of "flashing" occurring when the safe clear distance between line and a load is breached. The vehicle according to the present invention eliminates this possibility by mechanically restricting the vertical movement of its lifting apparatus to maintain a minimum distance of 2.75 meters from any overhead line equipment;

(ii) Network Rail's "Guidance for Managing Plant Working next to lines open to traffic Issue 2"—at present, vehicles are not permitted to operate with an adjacent line open if there is any possibility that a part of the vehicle or its load could foul the adjacent line. The vehicle according to the present invention eliminates this possibility by mechanically limiting the rotational movement and the reach of its lifting apparatus to ensure than neither it, nor its load, can extend beyond the footprint of the rail vehicle on one side, i.e. beyond one side of its outermost vertical projection on the ground.

Figure 5:
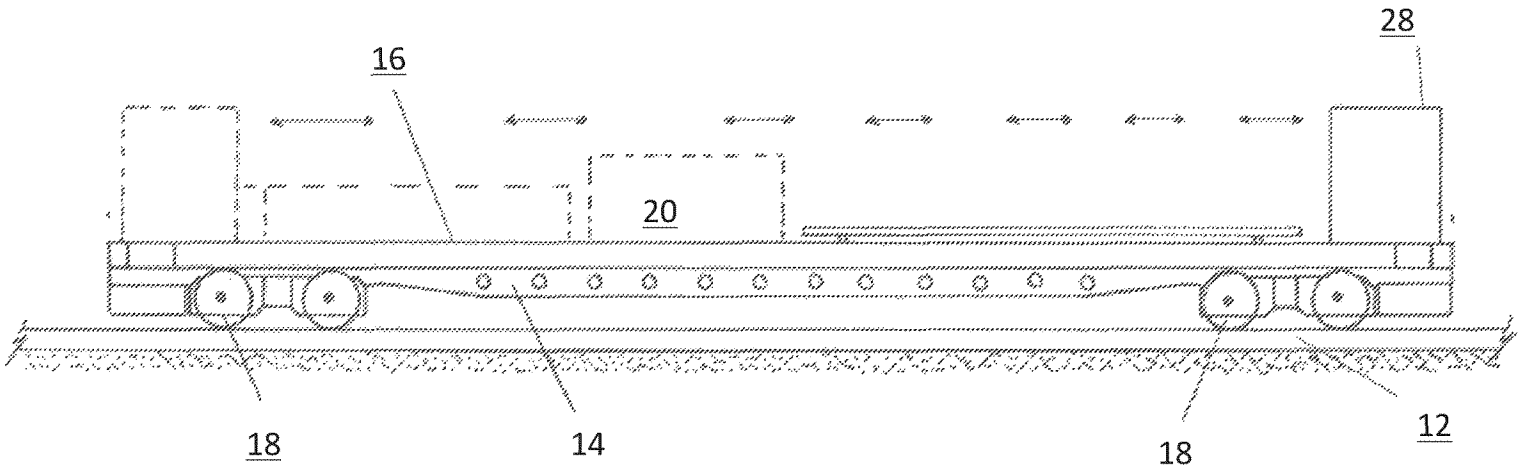
FIG. 5 shows a schematic side view representation of the railway vehicle of FIG. 4.

To the best of the applicant's knowledge, there is presently no dedicated rail-only track demountable vehicle that is self mountable/dismountable onto the railway track. Furthermore, to the best of the applicant's knowledge there is presently no such vehicle which is additionally provided with lifting apparatus (28) which can move longitudinally along its length whist carrying a load (see FIG. 5). Accordingly, the vehicle according to the present invention can accomplish many types of engineering and maintenance tasks that previously have required multiple different machines. As an example, when carrying out wet bed replacement, the required resources usually consists of a road-rail vehicle (very expensive), separate covered wagon trailers, separate local site lighting, 1 tonne ballast bags delivered separately by road (expensive), and various tools to be loaded onto the road-rail vehicle or other vehicle (s) by hand. Utilising the vehicle (10) of the present invention, all equipment and materials can be preloaded ready for the task in hand. This will greatly reduce costs as the labour, plant and material handling elements will be minimised.

Indeed, the vehicle of the present invention may be adapted for many maintenance and renewals tasks relating to track and trackside equipment, including:

(a) various track work such as wet bed repairs, scrap recovery, rail renewals and transport, switch & crossing component repair, sleeper replacement, welding, ballast movement, ballast ploughing, ballast brushing, tamping, vacuum excavation and replacement etc.

(b) vegetation work such as tree cutting, flailing, chipping, weed killing, line side clearance etc.

(c) civil work such as concreting, material handling, cabinet placement, line side furniture, handrail fitting, troughing placement, minor piling, structure construction and repairs etc.

(d) signalling & telecommunications and overhead line work such as cherry picker tasks, overhead line cable runs and repairs, S&T cable runs and repairs, line side cabinet placement, S&C motor repairs etc.

(e) other ancillary work such as water jetting, vacuum cleaning, drain clearance, plant transport, people carrying, lighting tower provision etc.

The above list is not conclusive and other uses of the vehicle of the present invention will likely become apparent.

Although difficult to quantify, the commercial benefits arising from the vehicle (10) of the present invention are likely to be numerous, particularly in view of its ability to maximise possession windows. Listed below are some of the potential savings—

Single line only blocks would alleviate disruption to trains to a minimum as adjacent lines could continue to accommodate passing. Savings would be fully dependant on commercial arrangements between rail network operations, freight operating companies (FOC's) and train operating company's (TOC'S) but they will be substantial. In addition, by complying with major safety legislation, this could result is some engineering, maintenance and inspection works becoming commercially viable due to associated reductions in the cost of disruptions (if any).

Utilisation of extremely restricted midweek possessions would become commercially viable in view of the reduced self-mounting/dismounting times involved as compared to existing vehicles.

Working under live overhead lines becomes possible hence there is no need for costly isolations being implemented then reinstated before and after each possession window. In addition with the restricted possessions available especially mid-week this could produce up to 30% additional working time being available which again reduces the overall unit costs.

The combination of the above advantages alone would alleviate many of the major issues effecting railway engineering tasks that presently exist.

The invention claimed is:

1. A self-propelled vehicle comprising:

(i) a chassis;

(ii) a working surface connected to the chassis for supporting at least one of equipment, materials, and personnel;

(iii) rail-engaging rolling means connected to the chassis for travel on a railway track;

(iv) positioning means connected to the chassis for lifting the vehicle and moving it laterally with respect to a direction of rail travel between a trackside location and an over-the-track location; and (v) a lifting apparatus;

wherein the working surface extends over the chassis and above the rail-engaging rolling means;

wherein the lifting apparatus is mountable on the chassis and moveable along the length of the working surface; and wherein the positioning means comprises at least two sets of opposing telescopically extendable shifting means connected to the vehicle for moving the vehicle in a substantially horizontal direction over the ground and proximate front and rear ends of the chassis respectively, each set being provided with two telescopically extendable primary lifting means depending from opposite ends of the opposing telescopically extendable shifting means for engagement with the ground to lift the vehicle in a substantially vertical direction.

2. The self-propelled vehicle according to claim 1, wherein a secondary supporting means is connected to the chassis for at least one of:

engagement with the ground to lift the vehicle in a substantially vertical direction; and supporting the vehicle in a substantially stationary manner relative to the ground during operation of the positioning means.

3. The self-propelled vehicle according to claim 2, wherein the secondary supporting means depends from the chassis at a position laterally between each pair of primary lifting means.

4. The self-propelled vehicle according to claim 1, wherein all lifting means are independently telescopically extendable.

5. The self-propelled vehicle according to claim 1, wherein all shifting means are independently telescopically extendable.

6. The self-propelled vehicle according to claim 1, wherein the shifting means extend substantially horizontally across the lateral width of the chassis and the primary lifting means depend substantially vertically from the shifting means at opposite ends thereof.

7. The self-propelled vehicle according to claim 6, wherein the primary lifting means depend from the shifting at positions laterally beyond both the chassis and the rail-engaging rolling means at opposite longitudinal sides of the chassis.

8. The self-propelled vehicle according to claim 1, wherein the lifting apparatus is mountable for rotational movement relative to the chassis about a vertical axis.

9. The self-propelled vehicle according to claim 8, wherein the angle of rotation of the lifting apparatus about the vertical axis relative to the working surface can be physically and permanently limited to an angular range which is less than 360 degrees.

10. The self-propelled vehicle according to claim 9, wherein the rotational movement of the lifting apparatus about the vertical axis is configurable so as to be limited to a maximum angle lying within the range of 180 degrees to 200 degrees.

11. The self-propelled vehicle according to claim 1, wherein vertical movement of any part of the lifting apparatus relative to a stowed position above the working surface is configurable so as to maintain a minimum distance of 2.75 meters from any overhead line equipment.

12. A method of mounting a self-propelled vehicle onto a railway track, the self-propelled vehicle comprising (i) a chassis, (ii) a working surface connected to the chassis for supporting at least one of equipment, materials, and personnel, (iii) rail-engaging rolling means connected to the chassis for travel on a railway track, (iv) positioning means connected to the chassis for lifting the vehicle and moving it laterally with respect to a direction of rail travel between a trackside location and an over-the-track location, and (v) a lifting apparatus, wherein the working surface extends over the chassis and above the rail-engaging rolling means; and wherein the lifting apparatus is mountable on the chassis and moveable along the length of the working surface, and wherein the positioning means comprises at least two sets of opposing telescopically extendable shifting means connected to the vehicle for moving the vehicle in a substantially horizontal direction over the ground and proximate front and rear ends of the chassis respectively, each set being provided with two telescopically extendable primary lifting means depending from opposite ends of the opposing telescopically extendable shifting means for engagement with the ground to lift the vehicle in a substantially vertical direction, the method comprising:

(i) delivering the vehicle to a trackside location;

(ii) deploying the positioning means to lift the vehicle above the height of the railway track;

(iii) operating the positioning means to move the vehicle laterally with respect to a direction of rail travel from its trackside location to an over-the-track location;

(iv) operating the positioning means to lower the vehicle such that its rail-engaging rolling means engage with the railway track; and (v) stowing the positioning means to allow the vehicle to travel on the railway track.

13. The method of mounting a self-propelled vehicle according to claim 12, wherein the step of deploying the positioning means to lift the vehicle comprises telescopically extending at least four primary lifting jacks spaced around the vehicle until they engage the ground and lift the vehicle above the height of the railway track.

14. The method of mounting a self-propelled vehicle according to claim 12, wherein the step of deploying the positioning means to lift the vehicle is preceded by telescopically extending a shifting member away from a side of the vehicle in the direction of desired movement.

15. The method of mounting a self-propelled vehicle according to claim 14, wherein the step of telescopically extending a shifting member away from a side of the vehicle is preceded by telescopically extending at least one secondary support member connected to the chassis at a location intermediate the primary lifting jacks until it engages the ground to perform at least one of lifting and supporting of the vehicle during extension of the shifting member.

16. The method of mounting a self-propelled vehicle according to claim 15, wherein the step of operating the positioning means to move the vehicle laterally with respect to a direction of rail travel involves retracting any previously deployed secondary support member away from the ground; and retracting extended shifting members on one side of the vehicle whilst simultaneously extending retracted shifting members on the opposite side of the vehicle.

17. The method of mounting a self-propelled vehicle according to claim 12, wherein the step of stowing the positioning means to allow the vehicle to travel on the railway track involves retracting the primary lifting jacks away from the ground and retracting all extended shifting members on each side of the vehicle.

* * * * *